US008430481B2

(12) United States Patent
Ishii et al.

(10) Patent No.: US 8,430,481 B2
(45) **Date of Patent: *Apr. 30, 2013**

(54) HEAD ATTACHMENT MEMBER AND LIQUID EJECTION DEVICE

(75) Inventors: Hiroyuki Ishii, Nagano (JP); Hiroyuki Hagiwara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 68 days.

This patent is subject to a terminal disclaimer.

(21) Appl. No.: 13/013,961

(22) Filed: Jan. 26, 2011

(65) Prior Publication Data

US 2011/0187794 A1 Aug. 4, 2011

(30) Foreign Application Priority Data

Feb. 3, 2010 (JP) ..... 2010-021883

(51) Int. Cl.
*B41J 2/15* (2006.01)
*B41J 2/145* (2006.01)

(52) U.S. Cl.
USPC ..... 347/40; 347/67

(58) Field of Classification Search ..... 347/8, 16, 347/40, 42, 43, 49, 67, 104
See application file for complete search history.

(56) References Cited

U.S. PATENT DOCUMENTS 6,123,472 A 9/2000 Elgee
6,154,232 A * 11/2000 Hickman et al. ..... 347/40
6,913,341 B2 7/2005 Barinaga et al.

FOREIGN PATENT DOCUMENTS

JP 2000-289279 A 10/2000
JP 2005-053227 A 3/2005

* cited by examiner

*Primary Examiner* — Thinh Nguyen
(74) *Attorney, Agent, or Firm* — Global IP Counselors, LLP

(57) ABSTRACT

A plurality of liquid ejection heads is attached to a head attachment member with respect to a support drum for supporting an ejection-receiving medium and rotating about a rotation shaft. The head attachment member includes a plurality of attachment surfaces to which a plurality of head groups each including a plurality of liquid ejection heads is attached. Each of the attachment surfaces is arranged so as to be parallel to a tangent line which is tangent to a peripheral surface of the support drum at an intersection point of a line segment which connects the center of the support drum and the center on the first attachment surface between the head groups attached to the first attachment surface. The attachment surfaces are integrally and continuously formed.

8 Claims, 6 Drawing Sheets

HEAD ATTACHMENT MEMBER AND LIQUID EJECTION DEVICE

CROSS-REFERENCE TO RELATED APPLICATIONS

This application claims priority to Japanese Patent Application No. 2010-021883 filed on Feb. 3, 2010. The entire disclosure of Japanese Patent Application No. 2010-021883 is hereby incorporated herein by reference.

BACKGROUND

1. Technical Field

The present invention relates to a head attachment member to which a liquid ejection head is attached so as to face a rotating support drum, and to a liquid ejection device.

2. Related Art

Known liquid ejection devices for ejecting a liquid to an ejection-receiving medium include inkjet recording devices, for example, for ejecting ink as the liquid to print on a paper, recording sheet, or other ejection-receiving medium.

Liquid ejection devices have been proposed in which an ejection-receiving medium is wound onto the periphery of a drum which rotates about a shaft, and printing is applied to the ejection-receiving medium by an inkjet recording head provided on the periphery of the drum, for example (see Japanese Laid-Open Patent Publication No. 2005-53227 and Japanese Laid-Open Patent Publication No. 2000-289279, for example).

Japanese Laid-Open Patent Publication No. 2005-53227 discloses a liquid ejection device in which a printing bar, to which a plurality of liquid ejection heads is fixed, is fixed to a printing bar frame structure.

Japanese Laid-Open Patent Publication No. 2000-289279 (p. 4, FIG. 3) discloses a liquid ejection device having a print cartridge carrying table fixed in relation to a drum, wherein the print cartridge carrying table is configured so that a print cartridge in which a liquid ejection head is fixed to the bottom surface thereof is fitted and attached to two frame members and carrying table constituent elements which are fixed to four flat parts provided on the frame members.

SUMMARY

However, in a case in which a plurality of liquid ejection heads is radially arranged in the peripheral direction of a support drum, as in Japanese Laid-Open Patent Publication No. 2005-53227, since a printing bar in which a plurality of liquid ejection heads is attached must be attached to the printing bar frame structure at different angles with respect to the support drum, each printing bar must be positioned with respect to the drum, which involves a complex operation, and problems arise in that highly precise positioning is difficult to achieve, and the attachment direction and the distances to the drum are no longer uniform.

The technique of Japanese Laid-Open Patent Publication No. 2000-289279 also has drawbacks in that the relative angles of the four flat parts are difficult to form with high precision with respect to the drum, positioning the liquid ejection heads in each of the four flat parts for attachment with respect to the drum is a complex operation, highly precise positioning is difficult to achieve, and the attachment direction and the distances to the drum are no longer uniform.

In view of the foregoing, an object of the present invention is to provide a head attachment member and a liquid ejection device whereby the distances and directions of the liquid ejection heads in a head group with respect to a platen can be made uniform and printing quality can be enhanced merely by positioning the head attachment member by a simple operation.

One aspect of the present invention for achieving the abovementioned objects is a head attachment member to which a plurality of liquid ejection heads is attached with respect to a support drum for supporting an ejection-receiving medium and rotating about a rotation shaft. The head attachment member includes a plurality of attachment surfaces to which a plurality of head groups each including a plurality of liquid ejection heads is attached. Each of the attachment surfaces is arranged so as to be parallel to a tangent line which is tangent to a peripheral surface of the support drum at an intersection point of a line segment which connects the center of the support drum and the center on the first attachment surface between the head groups attached to the first attachment surface. The attachment surfaces are integrally and continuously formed.

In this aspect, the liquid ejection heads and the support drum can be positioned, and in particular, the distances between the liquid ejection heads and the support drum can be made uniform, merely by fixing the liquid ejection heads to the plurality of integrally and continuously formed attachment surfaces, without separately positioning each liquid ejection head with respect to the support drum. Printing quality can therefore be enhanced.

Another aspect of the present invention resides in a liquid ejection device including the head attachment member according to the aspect described above, the liquid ejection heads attached to the attachment surfaces of the head attachment member, and the support drum configured to support the ejection-receiving medium.

In this aspect, the liquid ejection heads and the support drum can be positioned, and in particular, the distances between the liquid ejection heads and the support drum can be made uniform, merely by fixing the liquid ejection heads to the plurality of integrally and continuously formed attachment surfaces, without separately positioning each liquid ejection head with respect to the support drum. Printing quality can therefore be enhanced.

A boundary line of the attachment surfaces adjacent to each other is preferably disposed parallel to an axial direction of the rotation shaft of the support drum. Through this configuration, by setting the relative positions of the boundary line and the rotation shaft, the liquid ejection heads are positioned with respect to the support drum, and positioning of the liquid ejection heads can therefore be easily accomplished with high precision.

The liquid ejection heads for ejecting the same type of liquid are preferably attached to the attachment surfaces. Through this configuration, the positions of head groups provided to the same head attachment member relative to each other can easily be set with high precision, and printing resolution can therefore be increased.

The head attachment member preferably has a flat surface disposed at an equal angle with respect to the attachment surfaces. Through this configuration, the liquid ejection heads and the support drum can easily be positioned via the flat surface.

BRIEF DESCRIPTION OF THE DRAWINGS

Referring now to the attached drawings which form a part of this original disclosure.

DETAILED DESCRIPTION OF EXEMPLARY EMBODIMENTS

The present invention will be described in detail based on embodiments.

Figure 1:
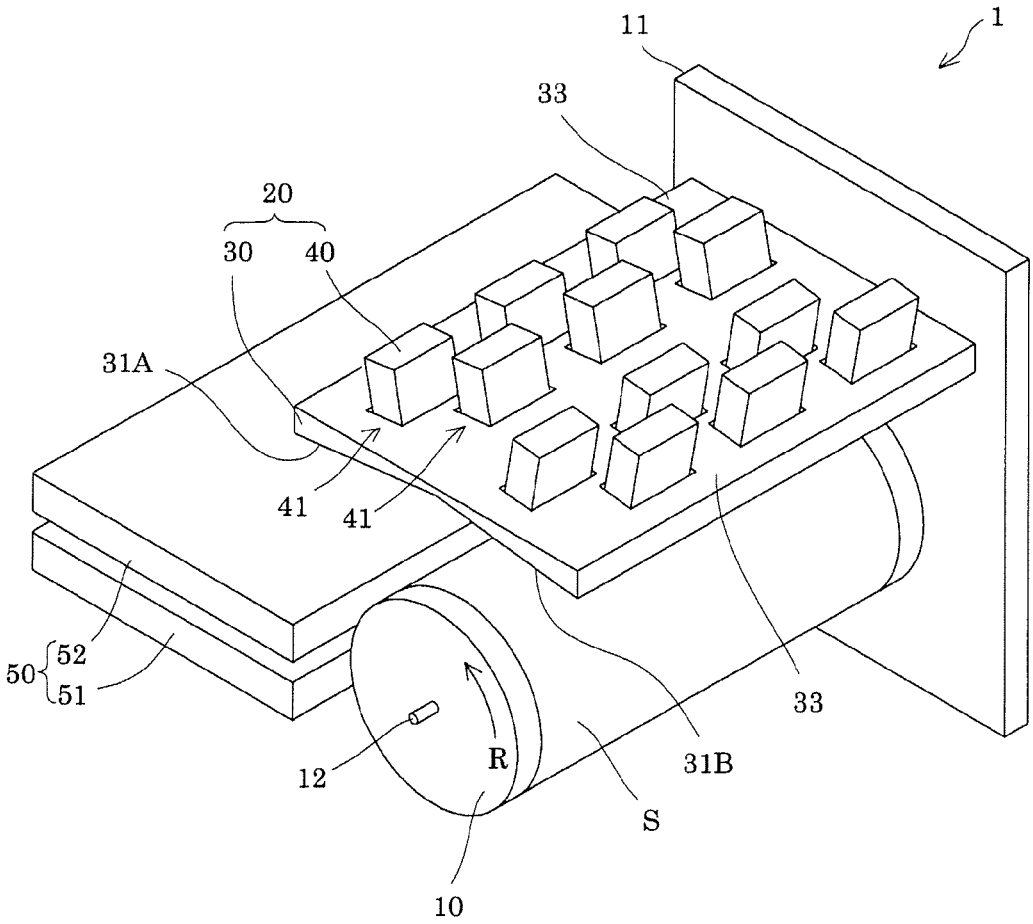
FIG. 1 is an overall perspective view showing the liquid ejection device according to an embodiment.
Figure 2:
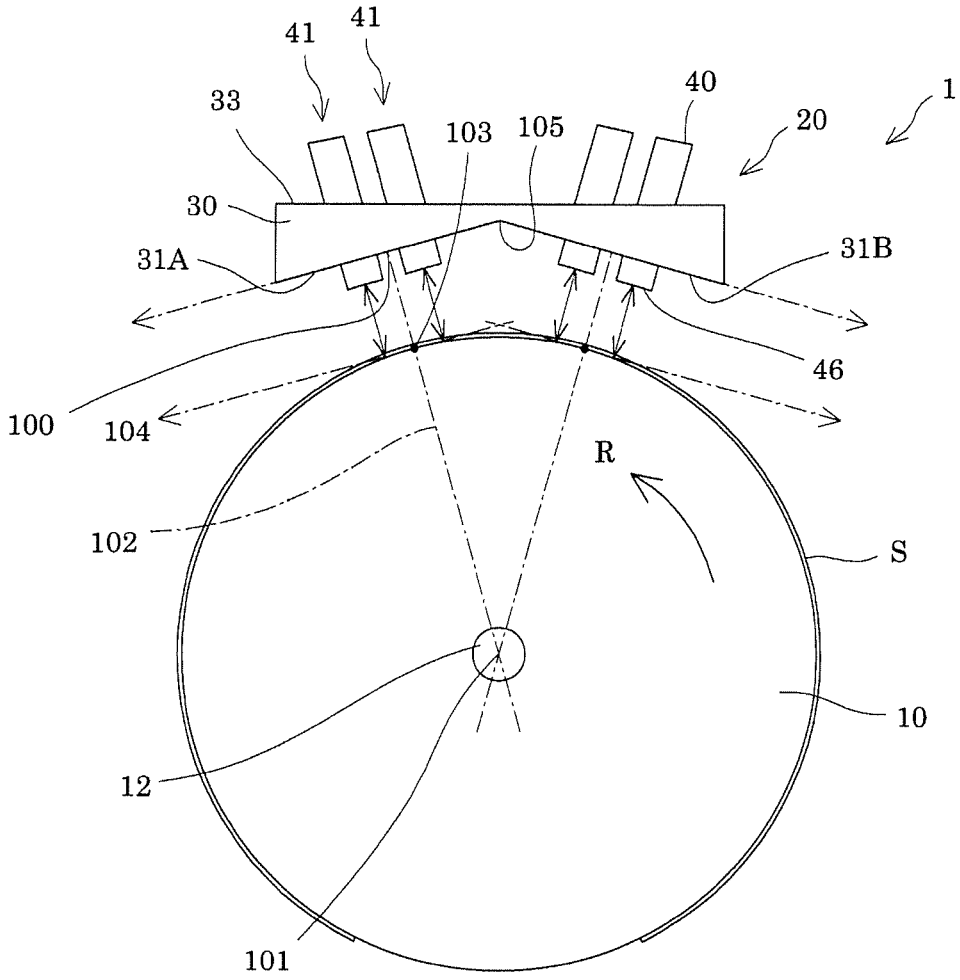
FIG. 2 is a side view showing the relevant parts of the liquid ejection device according to an embodiment.

FIG. 1 is an overall perspective view showing the liquid ejection device according to an embodiment of the present invention, and FIG. 2 is a side view showing the relevant parts of the liquid ejection device. As shown in the drawings, the liquid ejection device 1 of the present embodiment is provided with a drum-shaped support drum 10, a liquid ejection head unit 20 provided on the external periphery of the support drum 10, and a conveyance means 50 which has a feeding part 51 for feeding an ejection-receiving medium S to the support drum 10 and a removal part 52 for removing the ejection-receiving medium S from the support drum 10.

The support drum 10 has a rotation shaft 12 supported by a frame 11, and the support drum 10 rotates about the rotation shaft 12 in the direction of the arrow R shown in FIG. 1. Such rotation of the support drum 10 is performed by a drive motor or other drive means not shown in the drawings.

The support drum 10 retains the ejection-receiving medium S on the peripheral surface thereof The method whereby the support drum 10 retains the ejection-receiving medium S is not particularly limited, and the ejection-receiving medium S may be attached to the surface of the support drum 10 by suction, for example. As an example of another retaining method, the external peripheral surface of the ejection-receiving medium S may be electrically charged, and the ejection-receiving medium S may be attached to the support drum 10 by the action of induced polarization. Of course, a configuration may also be adopted in which a presser roller or the like is provided for holding the ejection-receiving medium S against the surface of the support drum 10.

The liquid ejection head unit 20 is provided with a head attachment member 30 and a plurality of liquid ejection heads 40 which is fixed to the head attachment member 30.

Figure 3:
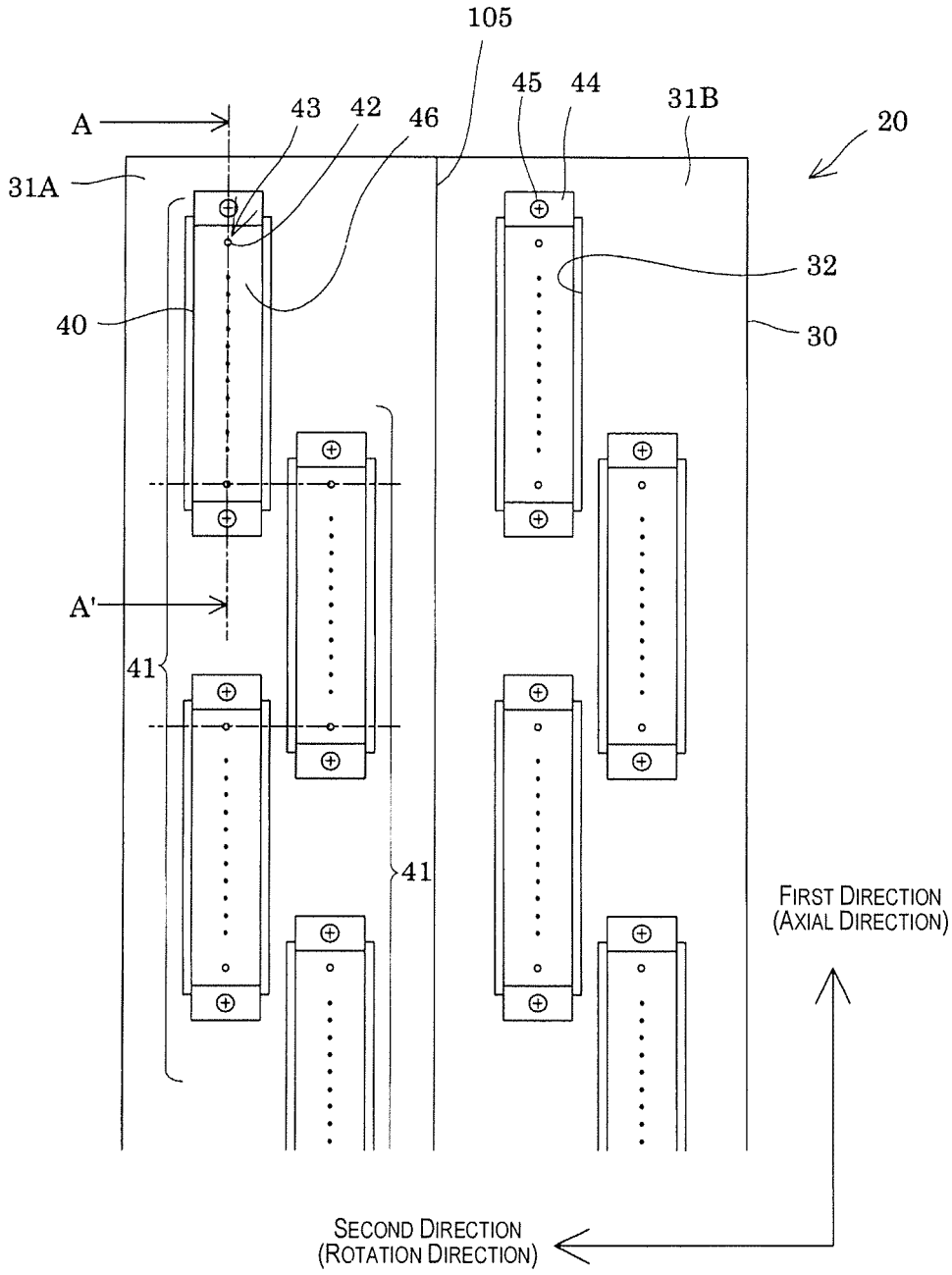
FIG. 3 is a plan view showing the liquid ejection head unit according to an embodiment.
Figure 4:
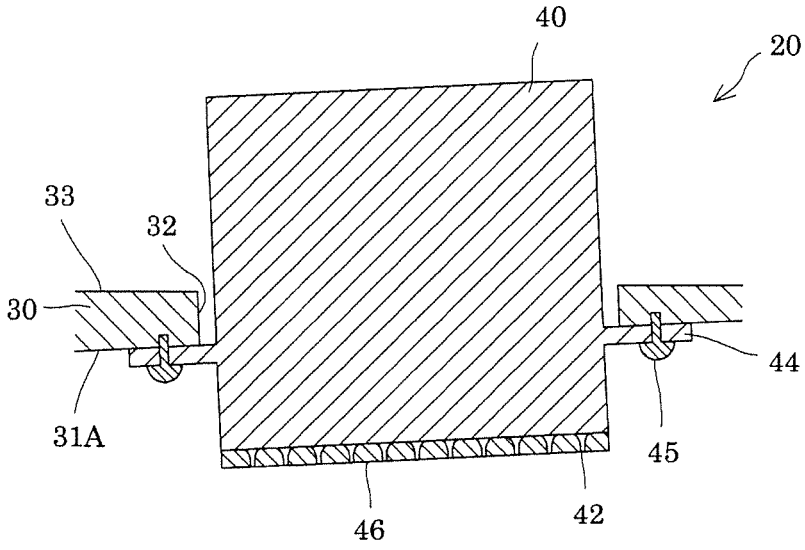
FIG. 4 is a sectional view showing the relevant parts of the liquid ejection head unit according to an embodiment.

The liquid ejection head unit 20 will be described in further detail. FIG. 3 is a plan view showing the liquid ejection surface side of the liquid ejection head unit, FIG. 4 is a sectional view along line A-A' of FIG. 3, and FIG. 5 is an enlarged sectional view showing the relevant parts of FIG. 2.

Figure 5:
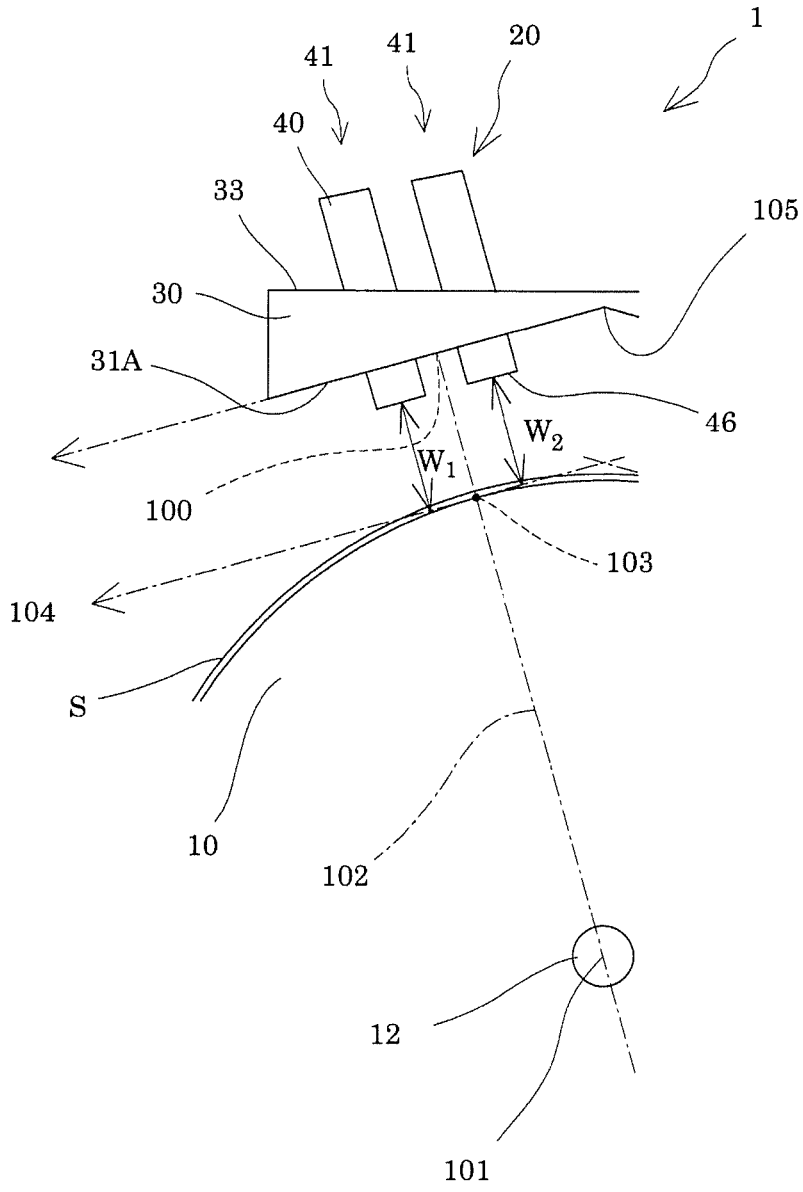
FIG. 5 is an enlarged side view showing the relevant parts of the liquid ejection head according to an embodiment.

As shown in FIGS. 2 and 5, the head attachment member 30 has a plurality of attachment surfaces 31A, 31B, to one side of which the liquid ejection heads 40 are fixed. In the present embodiment, two attachment surfaces 31A, 31B having mutually different inclination angles are provided. The attachment surfaces 31A, 31B are disposed so as to be aligned with the rotation direction R of the support drum 10.

The two attachment surfaces 31A, 31B are provided so as to be continuous and integrally formed. For the plurality of attachment surfaces 31A, 31B to be continuous means that adjacent attachment surfaces 31A, 31B are continuous, with no other surface (a surface other than that of the attachment surfaces 31A, 31B) being present between adjacent attachment surfaces 31A, 31B. For the attachment surfaces 31A, 31B to be integrally formed means that the head attachment member 30 having the plurality of attachment surfaces 31A, 31B is integrally formed by a single member. In the present embodiment, the attachment surfaces 31A, 31B are integrally provided by virtue of the head attachment member 30 being integrally formed by a single member.

A plurality of head groups 41 each composed of a plurality of liquid ejection heads 40 is fixed to each of the attachment surfaces 31A, 31B such as described above. Two head groups 41 are fixed to each of the attachment surfaces 31A, 31B in the present embodiment. A single head group 41 in the present embodiment is configured so that a plurality of liquid ejection heads 40 is aligned along a first direction which is the axial direction of the rotation shaft 12 of the support drum 10, as shown in FIG. 3. One or more nozzle rows 43 in which a plurality of nozzle openings 42 is aligned are provided to the liquid ejection heads 40. The liquid ejection heads 40 of the head groups 41 are arranged so that the nozzle openings 42 of the nozzle rows 43 are aligned in the alignment direction (first direction) of the liquid ejection heads 40.

The two head groups 41 attached to same attachment surfaces 31A, 31B are aligned in a second direction (rotation direction R of the support drum 10) which intersects with the first direction (axial direction), and the two head groups 41 are arranged in positions which are somewhat offset in the first direction. In other words, the liquid ejection heads 40 of the two head groups 41 fixed to the same attachment surface 31 A or 31 B are in a staggered arrangement, and the liquid ejection heads 40 of one adjacent head group 41 and the liquid ejection heads 40 of the other head group 41 are arranged so that the nozzle openings 42 at the end of the nozzle rows 43 are in the same position relative to each other in the second direction (rotation direction R). The nozzle openings 42 can thereby be provided at the same pitch in the first direction by the plurality of liquid ejection heads 40, and printing can be performed in all regions in the first direction.

The liquid ejection heads 40 are each attached to the attachment surfaces 31A, 31B in the present embodiment by providing a through-hole 32 through the head attachment member 30 in the thickness direction thereof, inserting the side of the liquid ejection head 40 opposite the nozzle openings 42 thereof into the through-hole 32 from the side of the attachment surfaces 31A, 31B, placing flange parts 44 which protrude from the sides of the liquid ejection head 40 against the attachment surfaces 31A, 31B, and fixing the flange parts 44 through the use of screw members 45, as shown in FIG. 4. The plurality of liquid ejection heads 40 fixed to the same attachment surfaces 31A, 31B is thereby provided so that liquid ejection surfaces 46 to which the nozzle openings 42 are provided are at the same height from the attachment surfaces 31A, 31B, and the liquid ejection surfaces 46 are at the same inclination angle as the attachment surfaces 31A, 31B.

As shown in FIG. 5, the two attachment surfaces 31A, 31B to which the two head groups 41 are fixed are also provided at an angle to each other so that when the head attachment member 30 is positioned with respect to the support drum 10, the two attachment surfaces 31A, 31B are each at a predetermined angle to the support drum 10. Specifically, one attachment surface 31A is disposed parallel to a tangent line 104 which is tangent to the peripheral surface of the support drum 10 at an intersection point 103 of a line segment 102 formed by connecting the rotational center 101 of the support drum 10 and the center 100 on the attachment surface 31A between mutually adjacent head groups 41. It is thereby possible to equalize the distances (platen gaps) between the peripheral surface of the support drum 10 and the liquid ejection surfaces 46 of the liquid ejection heads 40 which constitute mutually adjacent head groups 41 provided to the same attachment surface 31A or 31B. In other words, the distance between the tangent line 104 and the liquid ejection surfaces 46 of the liquid ejection heads 40 of one head group 41 is the same as the distance between the tangent line 104 and the liquid ejection surfaces 46 of the liquid ejection heads 40 of the other head group 41. Consequently, the distance $W_1$ between the surface of the support drum 10 and the liquid ejection surfaces 46 of the liquid ejection heads 40 of one head group 41 is the same as the distance $W_2$ between the surface of the support drum 10 and the liquid ejection surfaces 46 of the liquid ejection heads 40 of the other head group 41. Incidentally, since the distances $W_1$, $W_2$ between the surface of the support drum 10 and the liquid ejection surfaces 46 of the liquid ejection heads 40 are the flight distances traveled by the liquid from the liquid ejection surfaces 46 from ejection thereof to landing on the ejection-receiving medium S, by making the flight distances uniform among the plurality of head groups 41, landing deviation can be suppressed, and printing quality can be enhanced.

The center 100 on the attachment surface 31A between mutually adjacent head groups 41 referred to herein is the center (midpoint) in the second direction (rotation direction R) based on the nozzle rows 43 of the two head groups 41. For example, in a case in which only one nozzle row 43 is provided to each liquid ejection head 40, as in the present embodiment, the center 100 is the center between the nozzle rows 43 of the liquid ejection heads 40 adjacent in the rotation direction R. In a case in which two or more nozzle rows 43 are provided to each liquid ejection head 40, for example, the midpoint on the attachment surface 31A between the nozzle rows closest to each other is used as the center 100. The use of liquid ejection heads having different distances between nozzle rows is not preferred, but in a case of using liquid ejection heads in which the distance between nozzle rows differs for each head group, or in a case of using liquid ejection heads having different numbers of nozzle rows for each head group, for example, the center 100 may be the midpoint of the center positions of a plurality of nozzle rows of mutually adjacent liquid ejection heads, based on the center positions of a plurality of nozzle rows in a single liquid ejection head. The distances (flight distances) from the nozzle openings 42 to the surface of the support drum 10 are thereby made as uniform as possible.

The distances $W_1$, $W_2$ between the surface of the support drum 10 and the liquid ejection surfaces 46 of the liquid ejection heads 40 are essentially the distances between the peripheral surface of the support drum 10 and the nozzle openings 42 in the perpendicular direction of the liquid ejection surfaces 46. The reason for this is that the liquid ejection heads 40 are fixed to the head attachment member 30 so that the liquid ejection surfaces 46 are at the same angle as (parallel to) the attachment surfaces 31A, 31B.

By configuring the liquid ejection head unit 20 so that the attachment surfaces 31A, 31B are provided at two different inclination angles in a single head attachment member 30, and the liquid ejection heads 40 are fixed to each of the attachment surfaces 31A, 31B, the distances to the support drum 10 from the plurality of liquid ejection heads 40 fixed to the attachment surfaces 31A, 31B, and the inclination angles (liquid ejection directions) of the liquid ejection heads 40 can be positioned merely by positioning the head attachment member 30 with respect to the support drum 10. Consequently, there is no need to separately position the inclination angles of the liquid ejection heads 40 (head groups 41) fixed to the attachment surfaces 31A, 31B, and the relative positioning can easily be accomplished with high precision.

The two attachment surfaces 31A, 31B described above each have the same width in the first direction (axial direction). By thus arranging the two attachment surfaces 31A, 31B so that the boundary line 105 thereof is parallel to the axial direction (first direction) of the support drum 10, the two attachment surfaces 31A, 31B can be arranged parallel to the axial direction (first direction) of the surface of the support drum 10.

The surface of the head attachment member 30 on the opposite side thereof from the attachment surfaces 31A, 31B is a flat surface 33 in the present embodiment. The flat surface 33 is provided so as to be at the same angle with respect to the two attachment surfaces 31A, 31B. In other words, the attachment surfaces 31A, 31B have the same angle with respect to the flat surface 33. During setting of the position of the head attachment member 30 (liquid ejection head unit 20) with respect to the support drum 10, the flat surface 33 of the head attachment member 30 can be used as a reference for adjusting the angle with respect to the support drum 10, and positioning of the liquid ejection head unit 20 is facilitated.

A configuration may be adopted in which a different type of liquid is fed for each of the attachment surfaces 31A, 31B to the liquid ejection heads 40 fixed to the two attachment surfaces 31A, 31B, and a configuration may also be adopted in which the same type of liquid is fed to the liquid ejection heads 40 of the attachment surfaces 31A, 31B. For example, in a case in which the same type of liquid is fed to the liquid ejection heads 40 of the two attachment surfaces 31A, 31B, the resolution can be doubled by offsetting the liquid ejection heads 40 of one attachment surface 31A and the liquid ejection heads 40 of the other attachment surface 31B from each other by half (one-half pitch) the pitch of the nozzle openings 42 adjacent to each other in the first direction (axial direction of the rotation shaft 12), for example. In a highly precise positioning such that the nozzle openings 42 are offset by one-half pitch in this arrangement, printing defects occur unless the liquid ejection heads 40 fixed to the two attachment surfaces 31A, 31B are positioned with high precision relative to each other. In the present embodiment, two attachment surfaces 31A, 31B are provided to one head attachment member 30, and the relative positioning of the liquid ejection heads 40 fixed to each of the two attachment surfaces 31A, 31B can be set with high precision on the same member. Therefore, highly precise positioning can easily be performed, whereby the same type of liquid is ejected from the liquid ejection heads 40 fixed to the two attachment surfaces 31A, 31B, and the resolution of the liquid ejection heads 40 is doubled. Incidentally, a configuration in which a plurality of head attachment members having only one attachment surface is prepared, and the head attachment members are positioned with respect to the support drum 10 with high precision so that the nozzle openings 42 are offset by one-half pitch is difficult to achieve, and there is a risk of reduced printing quality. Even in a case in which the same type of liquid is ejected from the liquid ejection heads 40 fixed to the two attachment surfaces 31A, 31B, the liquid ejection heads 40 of the attachment surfaces 31A, 31B may be provided in the same positions in the second direction rather than being offset by one-half the pitch of the nozzle openings 42 in the first direction. In this case, although the resolution is not doubled, high-speed printing is possible.

Figure 6A:
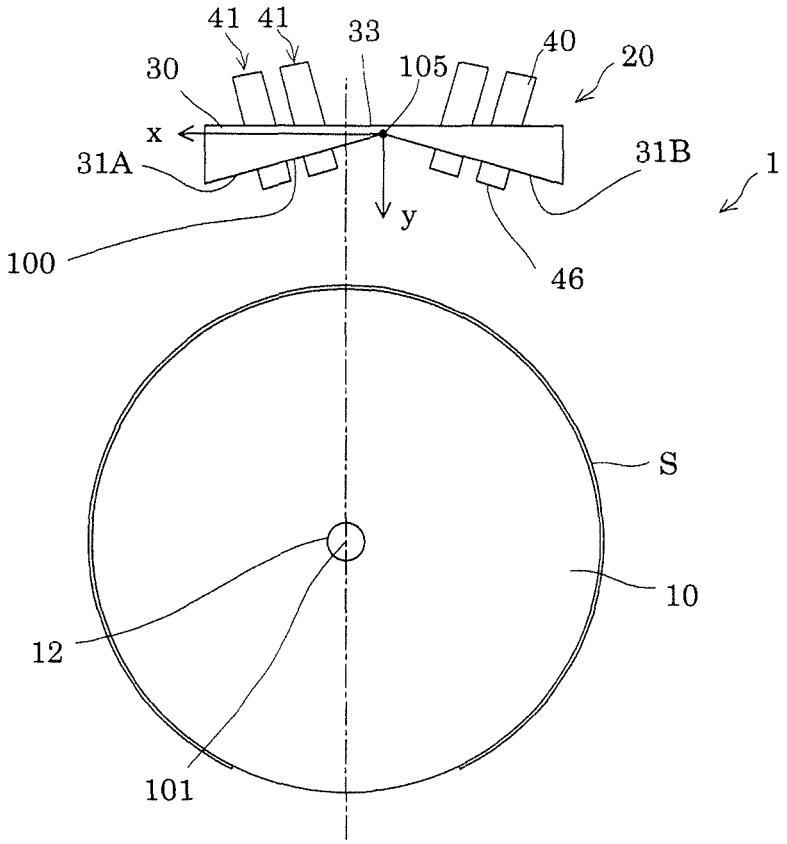
FIGS. 6A and 6B are side views showing the method for positioning the head attachment member according to an embodiment.
Figure 6B:
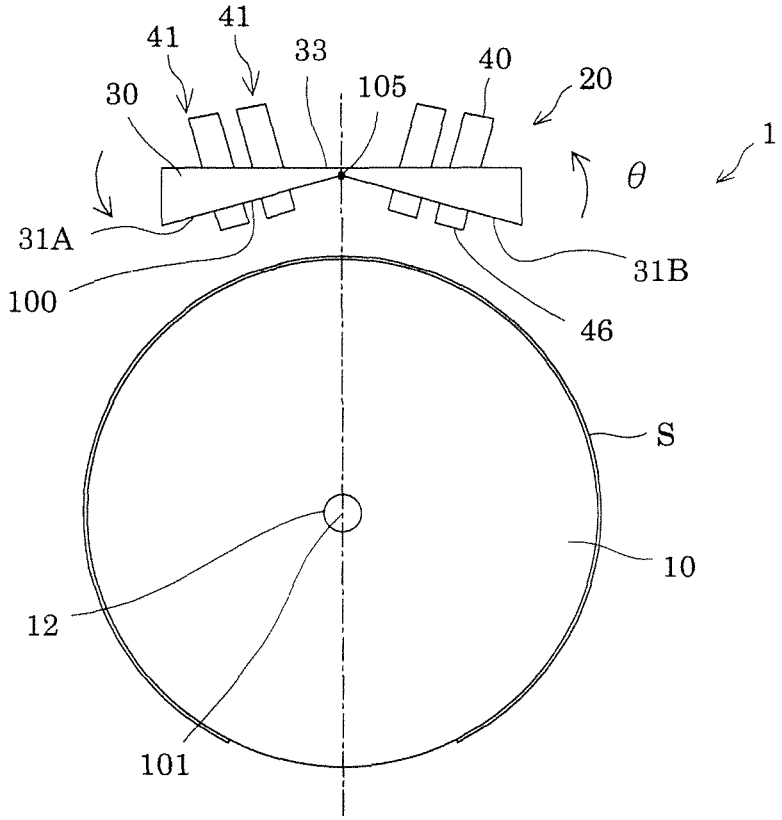

Following is a description of the method for assembling the liquid ejection device 1 such as described above, particularly the method for positioning the liquid ejection head unit 20 and the support drum 10. FIGS. 6A and 6B are side views showing the relevant parts of the method for manufacturing the liquid ejection device.

First, as shown in FIG. 6A, the liquid ejection head unit 20 is positioned in the direction (X direction and Y direction) intersecting the axial direction of the rotation shaft 12 of the support drum 10. At this time, by setting the positioning with respect to the support drum 10 on the basis of the boundary line 105 of the two attachment surfaces 31A, 31B, the positioning of the two attachment surfaces 31A, 31B can be set in the X direction and the Y direction simultaneously.

The angle θ of the liquid ejection head unit 20 with respect to the support drum 10 is then positioned, as shown in FIG. 6B. The angle θ of the liquid ejection head unit 20 is the inclination angle about the direction parallel to the axial direction of the rotation shaft 12, and in the present embodiment, since the boundary line 105 of the two attachment surfaces 31A, 31B is parallel to the axial direction of the rotation shaft 12, the inclination angle θ of the liquid ejection head unit 20 about the boundary line 105 is adjusted. At the time of this adjustment, the inclination angle θ of the liquid ejection head unit 20 can easily be positioned by specifying the angle of the flat surface 33 with respect to the perpendicular direction in advance. The inclination angle θ can also be positioned by using a level gauge or the like to make the flat surface 33 horizontal or perpendicular. The position in the X direction and Y direction, and the inclination angle θ can be computed in advance by calculations based on such factors as the position of the liquid ejection head unit 20, the outside diameter of the support drum 10, and the angle formed by the two attachment surfaces 31A, 31B.

The liquid ejection head unit 20 is thus formed by integrally and continuously providing the plurality of attachment surfaces 31A, 31B attached at a predetermined angle, and fixing the liquid ejection heads 40 to the plurality of attachment surfaces 31A, 31B, and merely by positioning the liquid ejection head unit 20 with respect to the support drum 10, the distances between the support drum 10 and the liquid ejection surfaces 46 of the plurality of liquid ejection heads 40 can be made uniform. The plurality of liquid ejection heads 40 can therefore be positioned easily, in a short time, and with high precision.

An embodiment of the present invention is described above, but the basic structure of the present invention is not limited by the description given above.

For example, in the embodiment described above, two attachment surfaces 31A, 31B are provided to a single head attachment member 30, and two head groups 41 are attached to each of the attachment surfaces 31A, 31B. However, the number of attachment surfaces 31A, 31B is not particularly limited, and three or more attachment surfaces may also be provided.

In the embodiment described above, two head groups 41 are fixed to a single attachment surface 31A or 31B, but this configuration is not particularly limiting. For example, four head groups 41 may be provided to a single attachment surface 31A or 31B. In this case, since a plurality of liquid ejection heads 40 in the staggered arrangement shown in FIG. 3 can essentially be considered to constitute a single head group, two head groups in a staggered arrangement are then considered to be provided to a single attachment surface 31A or 31B. Consequently, the planar direction of the attachment surfaces 31A, 31B is preferably disposed parallel to the tangent line which is tangent to the peripheral surface of the support drum at an intersection point of a line segment formed by connecting the center of the support drum 10 and the center (midpoint) on the attachment surfaces 31A, 31B of the two head groups. The distances between the support drum 10 and the liquid ejection surfaces 46 of the liquid ejection heads 40 can thereby be made uniform between the two head groups, and printing quality can be enhanced.

In the embodiment described above, a single liquid ejection head unit 20 (head attachment member 30) is provided to the liquid ejection device 1, but this configuration is not particularly limiting, and two or more liquid ejection head units 20 may be provided, for example. In this case, the liquid ejection head unit 20 may be disposed higher or lower in the perpendicular direction of the support drum 10, or to the left or right in the horizontal direction, and the flat surface may also be disposed at a 45-degree or other angle with respect to the perpendicular direction.

In the embodiment described above, the flat surface 33 is provided to the head attachment member 30, but this configuration is, of course, not limiting, and a configuration may be adopted in which the head attachment member 30 has a uniform thickness, and a plate-shaped member having a crooked shape is used together with the attachment surfaces 31A, 31B, for example.

In the embodiment described above, a so-called line-type liquid ejection device 1 is described in which the liquid ejection head unit is fixed, and printing is applied to the ejection-receiving medium S merely by rotating the support drum 10, but this configuration is not particularly limiting, and the present invention can also be applied to a so-called serial-type liquid ejection device in which printing is applied while the liquid ejection head unit 20 is moved in the axial direction of the rotation shaft 12 of the support drum 10.

The present invention is applicable to liquid ejection heads in general, and can be applied to various types of inkjet recording heads and other recording heads used in printers and other image recording devices, color material ejection heads used to manufacture color filters for liquid crystal displays and the like, electrode material ejection heads used to form electrodes for organic EL displays, FEDs (Field Emission Displays), and the like, biological organic ejection heads used to manufacture bio chips, and other liquid ejection heads, for example.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A head attachment member to which a plurality of liquid ejection heads is attached with respect to a support drum for supporting an ejection-receiving medium and rotating about a rotation shaft, the head attachment member comprising:

a plurality of attachment surfaces, with a plurality of head groups each including a plurality of liquid ejection heads being attached to each of the attachment surfaces, each of the attachment surfaces being arranged so as to be parallel to a tangent line which is tangent to a peripheral surface of the support drum at an intersection point of a line segment which connects the center of the support drum and the center on the attachment surface between the head groups attached to the attachment surface, and the attachment surfaces being integrally and continuously formed.

2. A liquid ejection device comprising:

the head attachment member according to claim 1;

the liquid ejection heads attached to the attachment surfaces of the head attachment member; and the support drum configured to support the ejection-receiving medium.

3. The liquid ejection device according to claim 2, wherein a boundary line of mutually adjacent ones of the attachment surfaces is disposed parallel to an axial direction of the rotation shaft of the support drum.

4. The liquid ejection device according to claim 3, wherein the liquid ejection heads for ejecting the same type of liquid are attached to the attachment surfaces.

5. The liquid ejection device according to claim 3, wherein the head attachment member has a flat surface disposed at an equal angle with respect to the attachment surfaces.

6. The liquid ejection device according to claim 2, wherein the liquid ejection heads for ejecting the same type of liquid are attached to the attachment surfaces.

7. The liquid ejection device according to claim 6, wherein the head attachment member has a flat surface disposed at an equal angle with respect to the attachment surfaces.

8. The liquid ejection device according to claim 2, wherein the head attachment member has a flat surface disposed at an equal angle with respect to the attachment surfaces.

* * * * *